United States Patent [19]

Matarainen

[11] Patent Number: 4,492,612

[45] Date of Patent: Jan. 8, 1985

[54] APPARATUS FOR ON-MACHINE SUPERCALENDERING OF PAPER

[75] Inventor: Reino Matarainen, Jyväskylä, Finland

[73] Assignee: Valmet OY, Finland

[21] Appl. No.: 266,108

[22] Filed: May 21, 1981

[30] Foreign Application Priority Data

May 22, 1980 [FI] Finland ..... 801666

[51] Int. Cl.[3] ..... D21G 1/00

[52] U.S. Cl. ..... 162/360.1; 100/161; 100/162 R; 100/163 R

[58] Field of Search ..... 100/161, 162 B, 162 R, 100/163 R, 163 A, 168, 169, 170; 162/358, 360, 361, 206, 205

[56] References Cited

U.S. PATENT DOCUMENTS

| | | | |
|---|---|---|---|
| 3,340,796 | 9/1967 | Link | 100/162 R |
| 4,128,053 | 12/1978 | Kankaanpää100 | 162 R/ |
| 4,131,063 | 12/1978 | Joutsjoki | 100/162 R |
| 4,211,165 | 7/1980 | Schill | 100/162 R |

FOREIGN PATENT DOCUMENTS

| | | | |
|---|---|---|---|
| 794581 | 2/1936 | France | 100/162 R |

OTHER PUBLICATIONS

MacDonald Editor; "Pulp and Paper Manufacture", 2nd Ed., vol. III, McGraw Hill Book Co., New York, 1970.

*Primary Examiner*—Steve Alvo

*Attorney, Agent, or Firm*—Steinberg & Raskin

[57] ABSTRACT

On-machine supercalender apparatus is provided at the output side of a paper machine and includes a plurality of soft and hard calendering rolls defining a plurality of soft calendering nips arranged successively in the direction of the run of the web being calendered, each soft calendering nip being formed by a pair of calendering rolls including a respective soft calendering roll and a corresponding respective hard calendering roll. According to the invention, the run of the web is guided successively through the nips in a manner such that the soft rolls do not participate in the guidance of the run of the web, i.e., the web is only guided in its run on the outer surfaces of the hard calendering rolls and, possibly, guide rolls.

15 Claims, 4 Drawing Figures

APPARATUS FOR ON-MACHINE SUPERCALENDERING OF PAPER

BACKGROUND OF THE INVENTION

This invention relates generally to on-machine supercalendering of paper and, more particularly, to methods and apparatus for on-machine supercalendering of paper leaving from the output side of a paper machine and wherein both hard and soft calender rolls form soft calendering nips with each other.

The calendering of a paper web leaving the discharge end of a paper machine is a well known final finishing treatment for determining the smoothness and gloss of the surfaces of the paper as well as its consistency. Such calendering is generally accomplished by guiding a continuous paper web successively through a series of nips formed by calendering rolls.

Conventionally, a paper web is calendered in a so-called calender stack situated immediately adjacent to the output side of the paper machine and, when required, the treatment is accomplished in a so-called supercalender.

Calender apparatus comprise calendering rolls which define calendering nips through which the web is passed. Such calendering rolls constitute either "hard" rolls or "soft" rolls. It is understood that as used herein, the term hard rolls designates rolls formed, for example, of chill casting or steel, the hard surfaces of which have been ground smooth. The term soft rolls as used herein designates rolls whose surfaces are made of flexible material. For example, a flexible material generally used for such soft rolls is paper wrapped in layers around the shaft of the roll and compressed to form a uniform roll coating.

Furthermore, as used herein, the term "soft nip" designates the contact line between a soft roll and a hard roll. The term "hard nip" is used to designate the contact line formed between two hard rolls.

It is possible depending upon the type of paper and the requirements therefor to machine finish the paper web in single nip calender, i.e., a calender comprising only one pair of rolls. In most cases, however, a calender stack will comprise between four and eight rolls forming three to seven nips. In fact, in separate calender stacks for machine-finishing there can be as many as ten pairs of nips.

It is usually an object to machine finish paper so that both sides of the paper have an equal gloss. Accordingly, at least two soft nips are generally provided located in a manner such that both surfaces of the paper web are pressed against the surface of a hard roll.

In connection with improving the efficiency of paper production, it has proven important to provide a calender unit in which both the functions of a machine-finishing unit as well as a supercalender are combined. In this connection, applicant's assignee's Finnish patent application No. 761764, corresponding to U.S. Pat. No. 4,128,053, discloses an on-machine supercalender apparatus adapted to be incorporated in a paper machine. Such supercalender comprises a roll stack including conventional hard rolls and essentially the same number of soft rolls which are located outside of the roll stack to form soft nips against the hard rolls.

In such a calender unit which constitutes a combination of a machine-finishing stack and a supercalender, the paper web can be supercalendered as desired immediately after the same leaves the paper machine without any intermediate phases. However, the results obtained are not entirely satisfactory in that the so-called super gloss effected by the calendering treatment is not uniform. In other words, some areas of the surface of the paper are glossier than other areas. Furthermore, it has been found that the paper web subjected to the calendering treatment turns a blackish color resulting at least partially from the fact that the hard nips are in fact too hard and unduly inflexible.

Other problems have arisen in connection with calendering paper webs. For example, it has been found that soft rolls of a calender, such as paper rolls as described above, are easily damaged during operation. In conventional calenders which are composed of groups of three or more rolls, it has not been possible to replace a soft roll when the same is damaged without breaking the web. In certain conventional four nip calenders, although it is possible to change a soft roll during operation without having to break the web, such results in one surface of the web being untreated or uncalendered.

As to the state of the art, reference is also made to Finnish Patent No. 55694, corresponding to U.S. Pat. No. 4,131,063 and applicant's Finnish patent applications No. 793200 and 793201, corresponding to U.S. Pat. Nos. 4,332,191 and 4,326,456, respectively.

SUMMARY OF THE INVENTION

Accordingly, one object of the present invention is to provide new and improved methods and apparatus for on-machine calendering in which the soft rolls can be replaced in a rapid manner without the necessity of breaking the web during roll replacement.

In other words, an object of the present invention is to provide improved calender apparatus and methods wherein the ratio of the down time to production time is maintained at a minimum.

Another object of the present invention is to provide new and improved calendering methods and apparatus in which the various nip pressures can be adjusted independently of each other.

Still another object of the present invention is to provide new and improved calendering apparatus having a relatively open structure so as to make possible the installation of web spreading, moisturizing and moisture measuring equipment therein and even prior to each calender nip, if required.

A further object of the present invention is to provide new and improved calendering apparatus wherein the transfer of the end of the web can be accomplished in a simple manner and wherein the paper web can be spread by conventional rope systems such, for example, after the second and fourth nips.

A still further object of the present invention is to provide new and improved calendering methods and apparatus wherein the side of the web located opposite to a roll being replaced will still be calendered at least by one other nip so that the quality of production will not be lowered.

Briefly, in accordance with the present invention these and other objects are attained by providing a calender which comprises a plurality of soft supercalendering nips formed by pairs of a soft calender roll and a hard calender roll, located successively in the direction of run of the web being calendered, the web run between the nips substantially free. According to the invention, the web is guided in a manner such that the soft rolls do not participate in the guidance of the run of the web. In other words, the web is guided between the calendering nips only by the hard calendering rolls and, possibly, by guide rolls.

DESCRIPTION OF THE DRAWINGS

A more complete appreciation of the present invention and many of the attendant advantages thereof will be better understood by reference to the following detailed description when considered in connection with the accompanying drawings in which.

DESCRIPTION OF THE PREFERRED EMBODIMENTS

Figure 1:
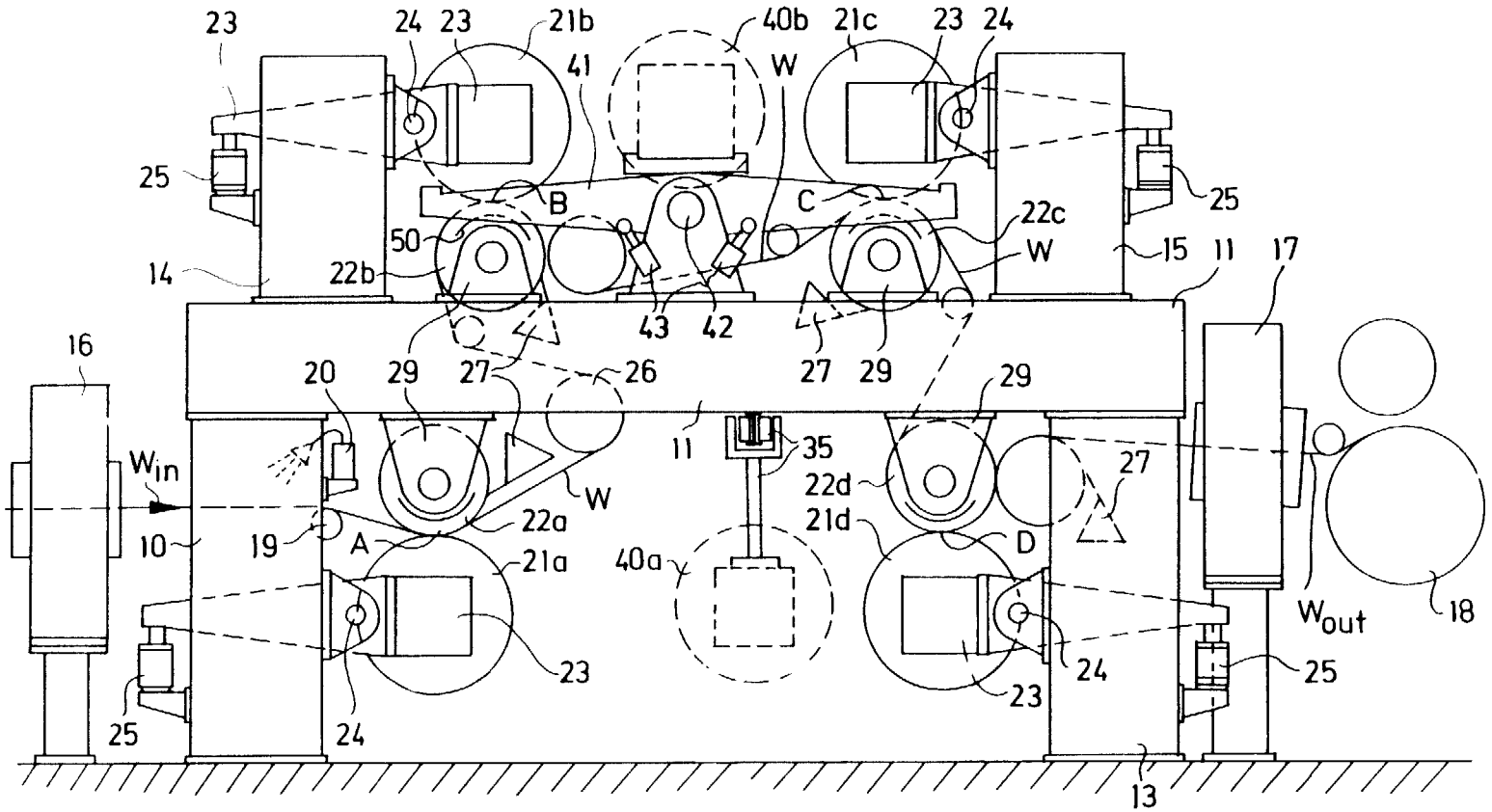
FIG. 1 is a schematic side elevation view of calender apparatus in accordance with the present invention, such apparatus including four nips situated in pairs vertically over each other.

Referring now to the drawings wherein like reference characters designate identical or corresponding parts throughout the several views and more particularly to the embodiment illustrated in FIG. 1, calender apparatus for a paper web W comprises a frame including upstanding frame columns 10 and 13 (only one of a pair of each shown) and a horizontally extending frame beam 11. Upstanding frame columns 14 and 15 are spaced from each other and mounted on the top of frame beam 11. A plurality of soft and hard calender rolls 21 and 22, respectively, are journalled to the frame as described in detail hereinbelow.

More particularly, the calender rolls 21 and 22 are mounted in four pairs, namely roll pairs 21*a*, 22*a*; 21*b*, 22*b*; 21*c*, 22*c*; and 21*d*, 22*d* and form soft calendering nips A, B, C, and D, respectively, through which web W passes. The web entering the calender apparatus from the preceding drying section of the paper machine is designated $W_{in}$ while the web leaving the calender apparatus is designated $W_{out}$. A conventional winding device is located at the exit side of the calender apparatus on which the web is continuously wound after it is supercalendered.

A weighing and moisture measuring device 16 is provided at the entry side of the calender apparatus while a similar measuring device 17 is provided at the exit or discharge side. The calender apparatus also comprises a spreading and tension measuring roll 19 and a moisturizing device 20. In the calender apparatus illustrated in FIG. 1, the calender rolls 21 comprise soft rolls such, for example, as the paper-coated rolls described above. The smaller diameter rolls 22 constitute hard rolls such, for example, as rolls made of chill casting or steel having smooth ground surfaces. The hard rolls 22 are fitted with conventional deflection compensating devices and can constitute, for example, Kusters rolls. The larger diameter soft rolls 21 may also be provided with deflection compensating equipment if required. In this connection, deflection compensation for both the soft and hard rolls 21 and 22 are usually required in at least broader or wider calender apparatus. Narrower calenders can usually be constructed without any deflection compensation in either soft or hard rolls 21 or 22. In cases where deflection compensation is not utilized, the linear pressure in the nips can be made uniform through the use of crown rolls. However, the use of crown rolls will provide a uniform linear pressure only at a certain nip loading.

In accordance with the present invention, the run of web W between nips A–D is guided only by the surfaces of hard rolls 22 and guide rolls 26 in order to attain the significant advantages discussed below.

Still referring to FIG. 1, the hard rolls 22 are journalled in bearings on bearing blocks 29 which are fixedly mounted to the frame beam 11. The soft rolls 20, however, are supported in journals on substantially horizontally extending double-arm lever pairs (only one lever of each pair shown) which themselves are pivotally supported on the frame beams 10, 13, 14 and 15 by cardan shafts 24. A power device 25 such, for example, as a hydraulic cylinder, is mounted on the frame to act on one end of levers 23. Thus, the soft rolls 21 and, therefore, nips A–D can be loaded at any desired linear pressure by means of the power device 25.

As mentioned above and as illustrated in FIG. 1, the calender roll pairs each composed of a soft roll 21 and a hard roll 22, are so positioned and the run of the web W so guided through nips A, B, C, and D by guide rolls 26, that insofar as the calender rolls are concerned, only the hard calendering rolls 22*a*, 22*b*, 22*c* and 22*d* guide the web. In other words, whereas the web W is guided by the various hard calender rolls 22 by wrapping the web over surface sectors thereof, only a line contact will occur between the web and any soft roll 21. As such, the soft rolls do not participate in the guidance of the run of the web.

As noted above, the hard rolls 22 are journalled in fixed bearing blocks 29 whereas the soft rolls 21 are journalled to supporting arms 23 which are movably mounted to the frame. More particularly, the supporting arms 23 are pivotally mounted by shafts 24 to the frame so as to be movable between a first position as shown in FIG. 1 wherein the soft calendering rolls 21 are in nip defining relationship with the corresponding ones of the hard calendering rolls 22 and a second position wherein the soft rolls are spaced from the corresponding hard rolls. Accordingly, when it is desired to replace a particular soft roll, such as when it is damaged, the supporting arms are pivoted to space the soft roll 21 from the corresponding hard roll 22. However, since the soft rolls do not play any part in the guidance of the web W, the continuous operation of the calender will not be interrupted during such roll replacement nor will there be any web breakage resulting from the movement of a soft roll.

It is an object of the present invention to provide a capability for replacement of a damaged soft roll 21 both rapidly and in a manner such that the continuous operation of the calender apparatus wil not be interrupted. To this end, a spare roll 40*a* is provided in the space defined between the lower soft rolls 21*a* and 21*b*. As noted above, since roll 21*a* does not function in any way to determine the run of the web, replacement of roll 21*a* will not cause any interruption in the run of web W. Transporting apparatus 35 are associate with frame beam 11 by which the spare roll 40*a* can be moved in a transverse direction.

Additionally, a spare soft roll 40*b* is located in the space defined between the soft rolls 21*b* and 21*c* in order to provide the capability of a rapid replacement of one of these soft rolls. When either one of the rolls 21*b* and 21*c* are damaged, the same can be moved from its position utilizing a crane which is typically found in the machine hall whereupon the spare roll 40*b* can be moved into the correct position. To facilitate the movement of the spare soft roll 40*b* into its proper position, a guide device comprising guide members 41 pivotally mounted on the frame beams 11 by a cardan shaft 42 is provided. The guide members 41 can be inclined selectively to the positions to either soft roll 21*b* or soft roll 21*c* by means of a power device 43, such as a hydraulic cylinder.

The particular embodiment of the calender apparatus illustrated in FIG. 1 utilizes four successive horizontal nips A, B, C and D, i.e., nips through which the web runs in a substantially horizontal direction. Additionally, two of the calendering nips A and D are situated substantially at a first level while the remaining calendering nips B and C are situated substantially at a second level above the first level. Doctor blades 27 may be utilized in conjunction with the hard rolls 22.

Figure 2:
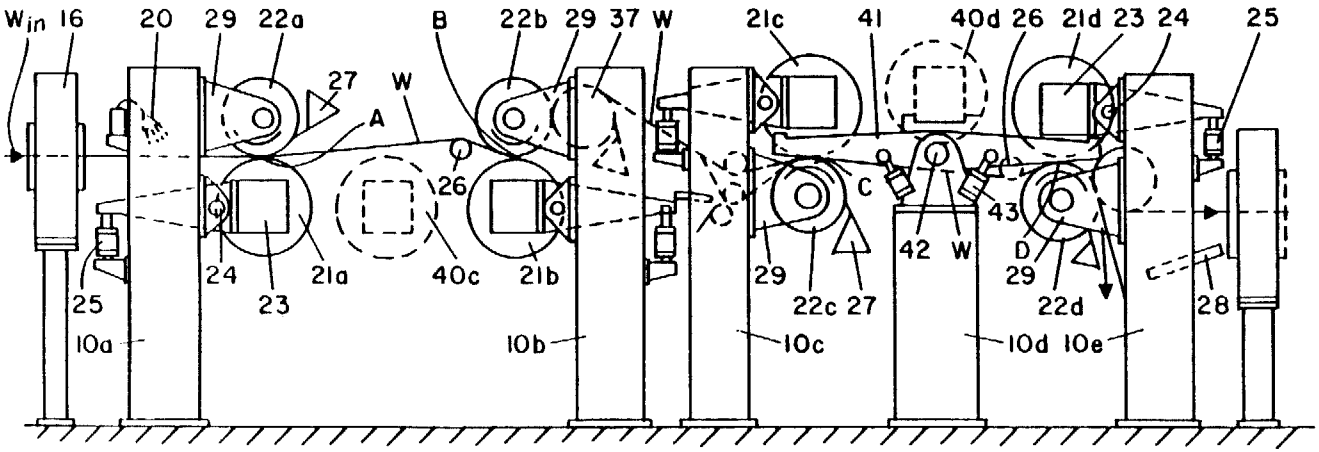
FIG. 2 is a schematic side elevation view of another embodiment of the present invention including four nips essentially located on the same horizontal level.

Referring now to the embodiment of the invention illustrated in FIG. 2, calender apparatus according to the present invention is illustrated wherein four successive horizontal nips A, B, C and D are situated at substantially the same horizontal level. The frame of the calender apparatus includes four separate upstanding frame columns 10*a*, 10*b*, 10*c* and 10*e*. As in the case of the embodiment illustrated in FIG. 1, hard calender rolls 22*a*, 22*b*, 22*c* and 22*d* are journalled in fixed bearing blocks 29 on respective frame columns and soft rolls 21*a*, 21*b*, 21*c* and 21*d* are journalled in double-arm supporting levers 23 which themselves are pivotally mounted on respective frame columns. Power devices 25 are associated with respective double-arm levers to pivot the same between first and second positions as described above in connection with FIG. 1 as well as to vary the nip pressure.

As seen in FIG. 2, a spare soft roll 40*c* is situated between soft rolls 21*a* and 21*b*. Further, a spare soft roll 40*d* together with various roll replacement equipment are mounted on an upstanding column 10*d* between frame columns 10*c* and 10*e*. More particularly, the spare roll 40*d* is located between guide members 41 which themselves are pivotally mounted by shaft 42 on column 10*d* so as to be turnable by means of power device 43 towards the position of a particular soft roll 21*c* and 21*d*. Thus, the guide members 41 can be turned in an appropriate direction to facilitate replacement when either one of the soft rolls 21*c* and 21*d* become damaged.

The calender apparatus illustrated in FIG. 2 is provided with an open construction so that there is sufficient room between nips A, B, C and D for various equipment such, for example, as moisture and tension measuring equipment which are not shown in detail for purposes of clarity. The structure of the frame is also relatively simple and inexpensive and an abundance of room is provided for soft roll replacing equipment. It is noted, however, that supercalendering apparatus according to the embodiment of FIG. 2 requires a great deal of space.

Returning to FIG. 1, it is noted that the web W is guided through the calender apparatus in a manner such that the same side of the web will contact a soft roll 21 in the end nips A and D while the opposite side of the web will contact the soft roll 21 in the central nips B and C. Similarly, in the embodiment illustrated in FIG. 2, the same side of the web W will contact the soft rolls 21 in the first two nips of the apparatus while the opposite side of the web will contact the soft roll 21 in the following two nips. This is advantageous in that even during the replacement of any one of the soft rolls of the calender apparatus as described above, both sides of the web will still be contacted by a soft roll 21 during the continued operation of the calender apparatus. Accordingly, no significant reduction in the quality of the paper produced will occur even during replacement of one of the soft rolls.

Figure 3:
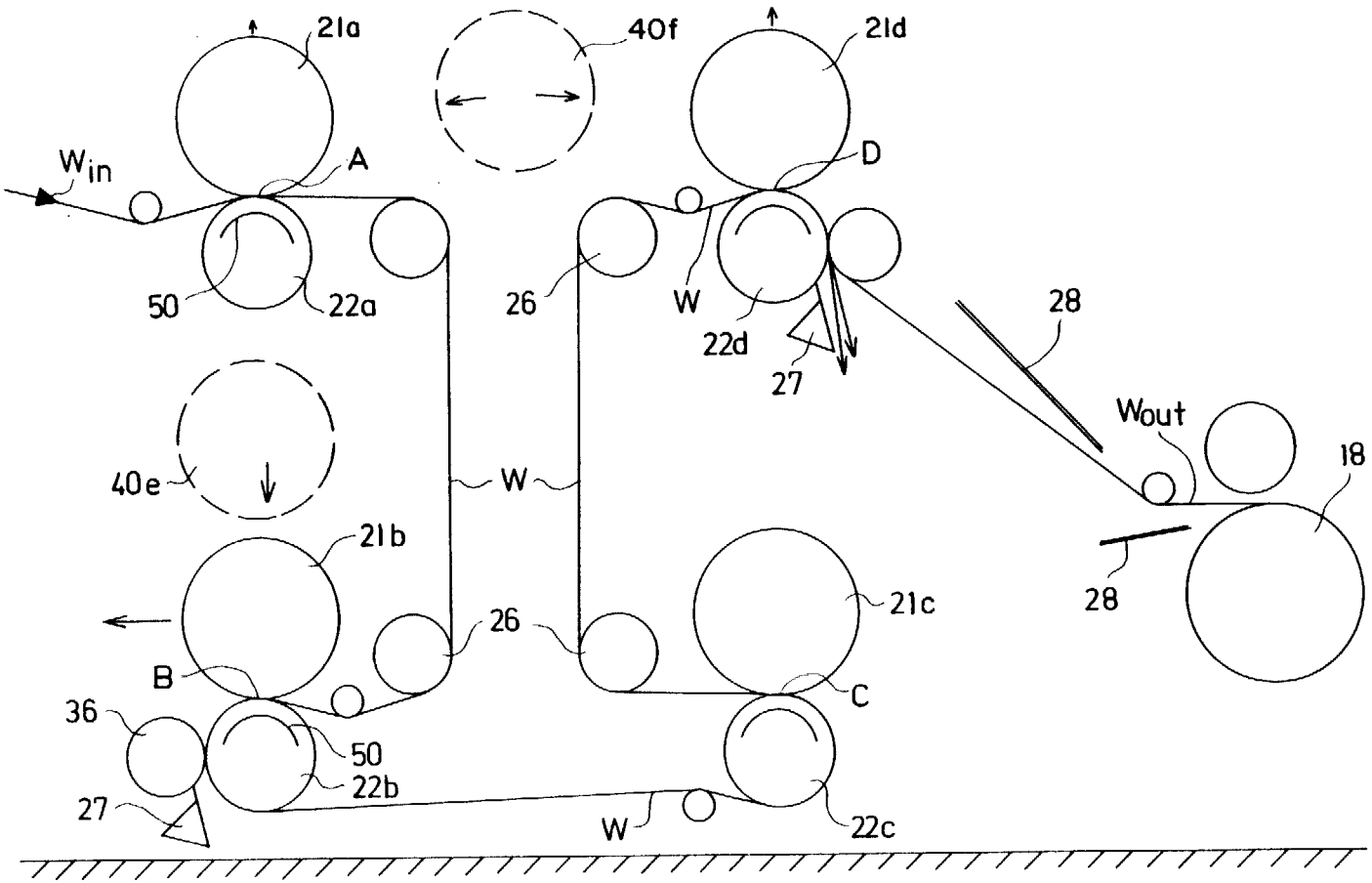
FIG. 3 is a side elevation view of yet another embodiment of a calender apparatus according to the present invention, this embodiment being a modification of that illustrated in FIG. 1, the frame structure being omitted from this figure for purposes of clarity.

Referring now to the embodiment illustrated in FIG. 3, the calender apparatus is similar to that illustrated in FIG. 1 in that four horizontal calender nips A–D are provided, two of which are located at a level vertically above the level at which the remaining two calender nips are situated. The calender roll pair 21*a*, 22*a* is located vertically above the calender roll pair 21*b*, 22*b* while the calender roll pair 21*d*, 22*d* is located vertically above the calender roll pair 21*c*, 22*c*. The web $W_{in}$ is directed into the calender apparatus to the nip A formed by the upper pair 22*a*, 22*a*. Unlike the embodiment illustrated in FIG. 1, the calender apparatus of FIG. 3 has a soft roll 21 at the top of each roll pair forming a horizontal nip. This is an advantageous configuration from the point of view of roll replacement. A spare soft roll 40*e* is located above the soft roll 21*b* while a spare soft roll 40*f* is situated between rolls 21*a* and 21*d*.

Guide plates 28 are also provided for directing the web W from the last calender nip D, guided by roll 36 and doctor blade 27, the winding device 18. It is noted that roll 36 functions only as a guided roll and does not form an actual calendering nip.

It is noted that in FIG. 3, none of the soft rolls 21 participate in the guiding of the web W and, further, that each side of the web W contacts two soft rolls 21 during its passage during the calendering apparatus so that replacement of any one of the soft rolls during continued operation of the apparatus will not substantially diminish the quality of the paper web obtained.

Figure 4:
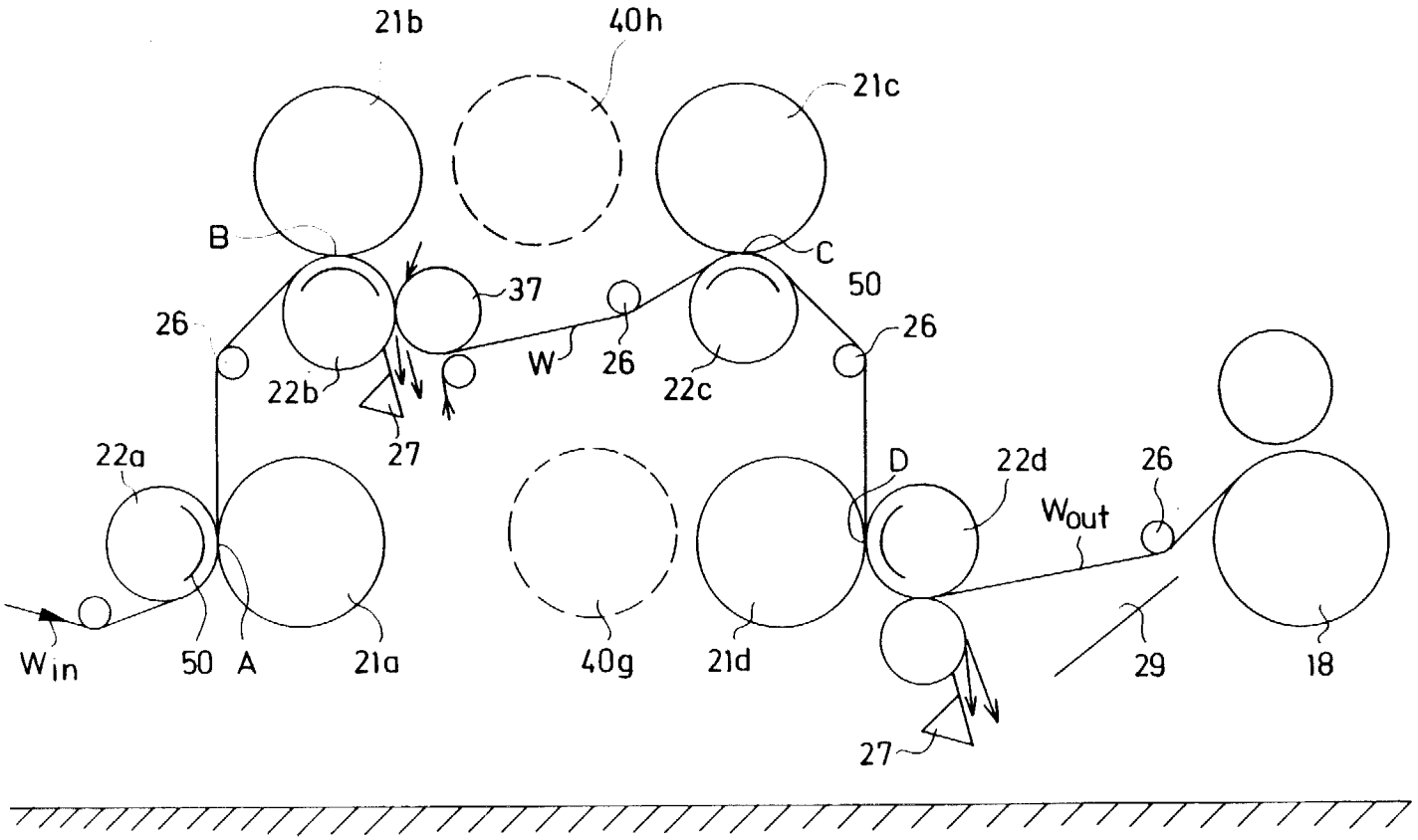
FIG. 4 is a side elevation view of still another embodiment of the present invention, the frame structure also being omitted from this figure.

The embodiment of the calender apparatus illustrated in FIG. 4 also comprises four calender nips A, B, C, and D, nips A and D being located at a level beneath the level at which nips B and C are located. The lower nips A and D are vertical nips, i.e., the web W passes substantially vertically through these nips, while the top nips B and C are horizontal nips. This arrangement is advantageous in that the top soft rolls 21*b* and 21*c* are substantially adjacent so that a single spare soft roll 40*h* can be easily arranged between them and serve as a replacement for either of the top soft rolls. Similarly, the lower soft rolls 21 and 21*b* are also proximate to each other so that a single spare soft roll 40*g* can be situated between them and which can serve as a replacement roll for either. A guide roll 37 may be provided which does not form an actual calendering nip with roll 22*b*.

In all of the embodiments of the calendering apparatus described above, four successive soft calendering nips composed of roll pairs of a soft roll and a hard roll 21 and 22 are provided. It is understood, however, that the invention can also utilize more or less than four of the roll pairs 21, 22. For example, the invention can be embodied in apparatus having five nips wherein one of the nips can function as a spare nip so that the web can be suitably calendered without interruption in all situations including the case where one of the nips is out of operation, such as due to a damaged soft roll. As noted above, this capability is possible mainly due to the fact that the soft rolls 21 do not participate in the guidance of the passage of web W and can be moved away for replacement purposes without causing breakage of the web or interrupting the calendering operation.

Calender apparatus in accordance with the invention is also advantageous since the end of web W can be gradually threaded through the apparatus by means of rope transfer systems which are known per se. In this connection, the web W can also be spread in an easy manner.

The invention provides calender apparatus whose efficiency is significantly higher than conventional apparatus since the interruption of production due to damaged soft rolls is significantly reduced with respect to the total production time.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. On-machine supercalender apparatus for treating a web leaving the discharge end of a paper machine, comprising:

a frame;

a plurality of soft and hard calendering rolls mounted to said frame defining a plurality of soft calendering nips arranged successively in the direction of the run of the web being calendered, the web run between the nips being substantially free, each soft calendering nip being formed by its own separate pair of calendering rolls including a respective soft calendering roll and a corresponding respective hard calendering roll, and such that each calender roll of a particular pair of calendering rolls forming a soft calendering nip is in nip defining relationship only with a corresponding respective calendering roll; and means for guiding the run of the web successively through the nips so that said soft rolls do not participate in the guidance of the run of the web, said guiding means including the outer surfaces of said hard calendering rolls; and supporting arms on which said soft calendering rolls are journalled, each of said supporting arms being movably mounted to said frame for selective movement between a first position wherein said soft calendering roll journalled thereto is in nip defining relationship with a corresponding hard calendering roll and a second position wherein said soft roll is spaced from said corresponding hard roll, wherein the soft rolls can be removed without any web breakage.

2. The combination of claim 1 wherein said guiding means further include guide rolls.

3. The combination of claim 1 wherein said supporting arms are pivotally mounted to said frame.

4. The combination of claim 1 further including power means for moving said supporting arms between said first and second positions.

5. The combination of claim 1 further including bearing blocks on which said hard calendering rolls are journalled, each of said bearing blocks being fixedly mounted to said frame.

6. The combination of claim 1 wherein said apparatus comprises four soft calendering nips, each nip being formed by a respective soft calendering roll and a corresponding respective hard calendering roll.

7. The combination of claim 1 wherein a first set of said plurality of calendering nips are situated substantially at a first level and a second remaining portion of said plurality of calendering nips are situated substantially at a second level above said first level.

8. The combination of claim 1 wherein said plurality of calendering nips situated substantially at a common horizontal level.

9. The combination of claim 8 wherein each pair of calendering rolls defining a respective calendering nip is mounted on a separate frame section.

10. The combination of claim 1 wherein each of said calendering nips constitutes a substantially horizontal nip through which the web passes in a substantially horizontal direction.

11. The combination of claim 1 wherein a first portion of said plurality of calendering nips constitutes substantially horizontal nips through which the web passes in a substantially horizontal direction and a second remaining portion of said plurality of calendering nips constitutes substantially vertical nips through which the web passes in a substantially vertical direction.

12. The combination of claim 1 wherein at least two calendering nips of said plurality of soft calendering nips are situated substantially at a common horizontal level and wherein each of said at least two nips are defined by an upper soft calendering roll and a lower hard calendering roll, and further including a spare soft calendering roll mounted on a device proximate to said upper soft calendering roll.

13. The combination of claim 12 further including guide means for guiding said spare roll toward the positions occupied by said upper soft calendering rolls.

14. The combination of claim 13 wherein said guide means include a guide device pivotally mounted to said frame and further including power means for pivoting said guide device.

15. The combination of claim 1 wherein at least two soft calendering nips are arranged such that the respective soft calendering rolls thereof contact one surface of the web and wherein at least two other soft calendering nips are arranged such that the respective soft calendering rolls thereof contact the other surface of the web.

* * * * *